US008360622B2

(12) United States Patent
Mora et al.

(10) Patent No.: US 8,360,622 B2
(45) Date of Patent: Jan. 29, 2013

(54) LED LIGHT SOURCE IN INCANDESCENT SHAPED LIGHT BULB

(75) Inventors: Peter Mora, Budapest (HU); Jozsef Fulop, Budapest (HU); Laszlo Petras, Budapest (HU); Peter Lucz, Budapest (HU)

(73) Assignee: GE Lighting Solutions, LLC, Cleveland, OH (US)

( * ) Notice: Subject to any disclaimer, the term of this patent is extended or adjusted under 35 U.S.C. 154(b) by 11 days.

(21) Appl. No.: 12/833,049

(22) Filed: Jul. 9, 2010

(65) Prior Publication Data

US 2012/0007486 A1 Jan. 12, 2012

(51) Int. Cl.
*H01J 61/52* (2006.01)
*H01J 5/48* (2006.01)

(52) U.S. Cl. ..... 362/498; 362/650; 362/249.02; 362/311.02; 362/800; 362/649

(58) Field of Classification Search ..... 313/498, 313/46; 362/126, 800, 650, 249.02, 311.02
See application file for complete search history.

(56) References Cited

U.S. PATENT DOCUMENTS

| | | | | |
|---|---|---|---|---|
| 5,929,788 | A * | 7/1999 | Vukosic | 340/908.1 |
| 2008/0258598 | A1 * | 10/2008 | Shuy | 313/46 |
| 2009/0046473 | A1 * | 2/2009 | Tsai et al. | 362/373 |
| 2011/0101861 | A1 | 5/2011 | Yoo | |

FOREIGN PATENT DOCUMENTS

| | | |
|---|---|---|
| KR | 100 961 840 | 6/2010 |
| WO | WO 2009/027922 | 3/2009 |
| WO | WO 2010/066841 | 6/2010 |

OTHER PUBLICATIONS

EP 11 17 3145 Search Report.

* cited by examiner

*Primary Examiner* — Anne Hines
*Assistant Examiner* — Jacob R Stern
(74) *Attorney, Agent, or Firm* — Fay Sharpe LLP

(57) ABSTRACT

An LED light bulb that includes a base providing an electrical connector and a substantially hollow envelope extending from the base. The light bulb further includes a metal space separator having a top side, bottom side and side wall that has a plurality of holes connected by at least one channel that extends through the interior of the separator, such that air can pass through the separator. At least one LED is mounted on the separator in electrical connection with the base connector.

16 Claims, 6 Drawing Sheets

LED LIGHT SOURCE IN INCANDESCENT SHAPED LIGHT BULB

BACKGROUND

Incandescent light bulbs are a source of electric light that creates light by running electricity through a resistive filament, thereby heating the filament to a very high temperature, so that it glows and produces visible light. Incandescent bulbs are made in a wide range of sizes and voltages, from 1.5 volts to about 300 volts. The bulbs consist of a generally glass or plastic enclosure with a filament of tungsten wire inside the bulb through which an electrical current is passed. Incandescent lamps are designed as direct "plug-in" components that mate with a lamp socket via a threaded Edison base connector (sometimes referred to as an "Edison base" in the context of an incandescent light bulb), a bayonet-type base connector (i.e., bayonet base in the case of an incandescent light bulb), or other standard base connector to receive standard electrical power (e.g., 120 volts A.C., 60 Hz in the United States, or 230V A.C., 50 Hz in Europe, or 12 or 24 or other D.C. voltage). The base provides electrical connections to the filament. Usually a stem or glass mount anchors to the base, allowing the electrical contacts to run through the envelope without gas/air leaks.

With reference to FIG. 1, a typical incandescent candle bulb is displayed. The envelope 11 generally comprises glass, although other light transmissive material may be used. The envelope 11 encloses a tungsten filament 13, through which an electrical current is passed. The base 15 includes two metal contacts 16, 18 that are attached to the filament. Two stiff wires 17, 19 are mechanically supporting the filament 13. When the bulb is hooked up to a power supply, an electrical current flows from one contact to the other, through the wires 16, 18 and the filament 13. A candle bulb is similar in function and general shape to other incandescent bulbs, but is generally smaller in size.

Incandescent light bulbs are widely used in household and commercial lighting, for portable lighting, such as table lamps, car headlamps, flashlights, and for decorative and advertising lighting. However, incandescent light bulbs are generally inefficient in terms of energy use and are subject to frequent replacement due to their limited lifetime (about 1,000 hours). Approximately 90% of the energy input is emitted as heat. These lamps are gradually being replaced by other, more efficient types of electric light such as fluorescent lamps, high-intensity discharge lamps, light emitting diodes (LEDs), etc. For the same energy input, these technologies give more visible light and generate much less heat. Particularly, LEDs consume a fraction of the energy used to illuminate incandescent bulbs and have a much longer lifetime (e.g. 50,000 to 75,000 hours). Furthermore, LED light sources are a very clean "green" light source and also provide good color reproduction.

However, a drawback of LED light bulbs is that they have a very limited tolerance to high temperature and their efficiency falls as the temperature rises. The LED devices cannot be operated at the temperature of an incandescent filament (rather, the operating temperature should be around room temperature). The lower operating temperature also reduces the effectiveness of radiative cooling. Current LED lamps have trouble with heat dissipation, since the heat exchange occurs in an enclosed volume. LEDs are not incorporated as part of the outer bulb; therefore, their housing had to be used as a heat sink. In a usual approach, the base of the LED replacement lamp included (in addition to the Edison base connector and the electronics) a relatively large mass of heat sinking material positioned such that it was contacting or otherwise in good thermal contact with the LED device(s).

Another issue is that unlike an incandescent filament, an LED chip or other solid state lighting device typically cannot be operated efficiently using standard 120V or 230V A.C. power. Rather, on-board electronics are typically provided to convert the A.C. input power to D.C. power of lower voltage amenable for driving the LED chips. As an alternative, a series string of LED chips of sufficient number can be directly operated at 120V or 230V, and parallel arrangements of such strings with suitable polarity control (e.g., Zener diodes) can be operated at 120V or 230V A.C. power, albeit at substantially reduced power efficiency. In either case, the electronics constitute additional components of the lamp base as compared with the simple Edison base used in integral incandescent or halogen lamps.

Accordingly, it is desirable to provide an LED light bulb with improved heat management and electronics that may be used as a replacement for a typical incandescent light bulb.

BRIEF DESCRIPTION

In certain embodiments disclosed herein as illustrative examples, an LED light bulb is provided that includes a base providing an electrical connection and a substantially hollow envelope extending from the base. The light bulb further includes a metal space separator having a top side, bottom side and side wall that has a plurality of holes. Opposite holes are connected by at least one channel that extends the length of the separator, such that air can pass through the separator. At least one LED is mounted on the separator in electrical connection with the base connector.

In certain embodiments disclosed herein as illustrative examples, an LED lamp is provided that includes an LED-based light source and an Edison-type base connector. The base is configured to electrically power the LED-based light source using electrical power received from the base connector. A first envelope half is provided and includes a first end that attaches to the base and a second end that opens in the opposite direction. A generally circular and planar separator is included that has a top side, a bottom side, and a sidewall. The second end of the first envelope half is mated to the bottom side of the separator. A second envelope half is adapted to attach to the top side of the separator. The separator includes a plurality of interior channels that extend between openings in the side wall. Additionally, at least one LED is mounted on the separator.

In yet another embodiment a candle-shaped LED light bulb for use as a replacement light bulb for an incandescent light bulb is disclosed. The light bulb includes an LED light source, a base, a light-diffusing envelope including a first envelope half and a second envelope half. The light bulb further includes a metal space separator having a top side and a bottom side. Each of the top side and the bottom side include a raised lip portion along the outer edge of the separator. The first envelope half has a first end that is attached to the base and a second end that is mated with to the bottom side. The second half is dome-like with an open end that is mated with the top side of the separator. At least one of said second end and said open end include ridges adapted to press-fit with said raised lip portions, creating an air-tight seal. The separator includes a plurality of holes disposed in the sidewall, oriented such that pairs of holes are directly across the length of the separator from one another and connected by a channel that extends the length of said separator, such that air can pass through the separator.

BRIEF DESCRIPTION OF THE DRAWINGS

The invention may take form in various components and arrangements of components, and in various process operations and arrangements of process operations. The drawings are only for purposes of illustrating preferred embodiments and are not to be construed as limiting the invention.

DETAILED DESCRIPTION

Figure 1:
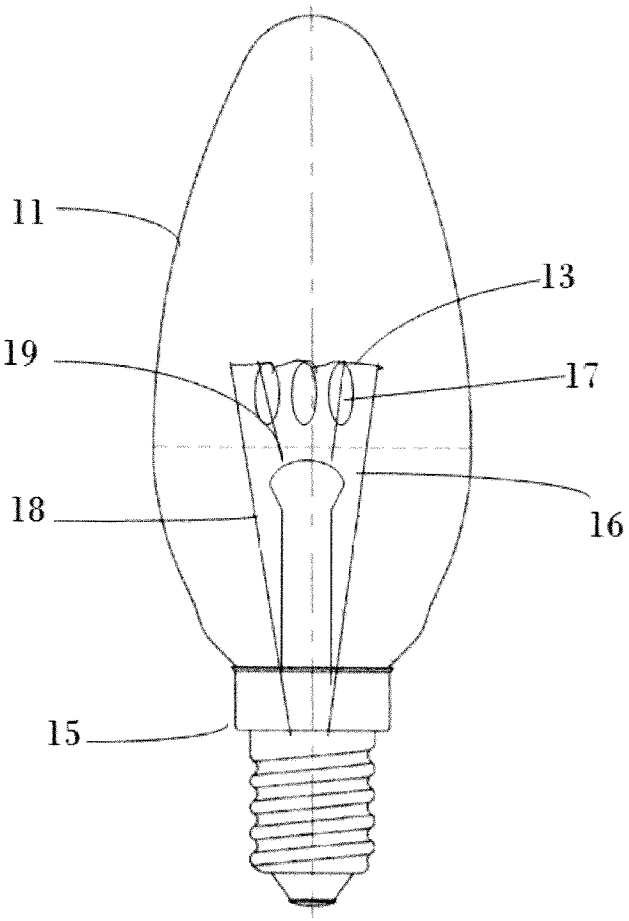
Fig. 1 (Prior Art)
FIG. 1 illustrates a conventional incandescent candle-shaped light bulb.
Figure 2:
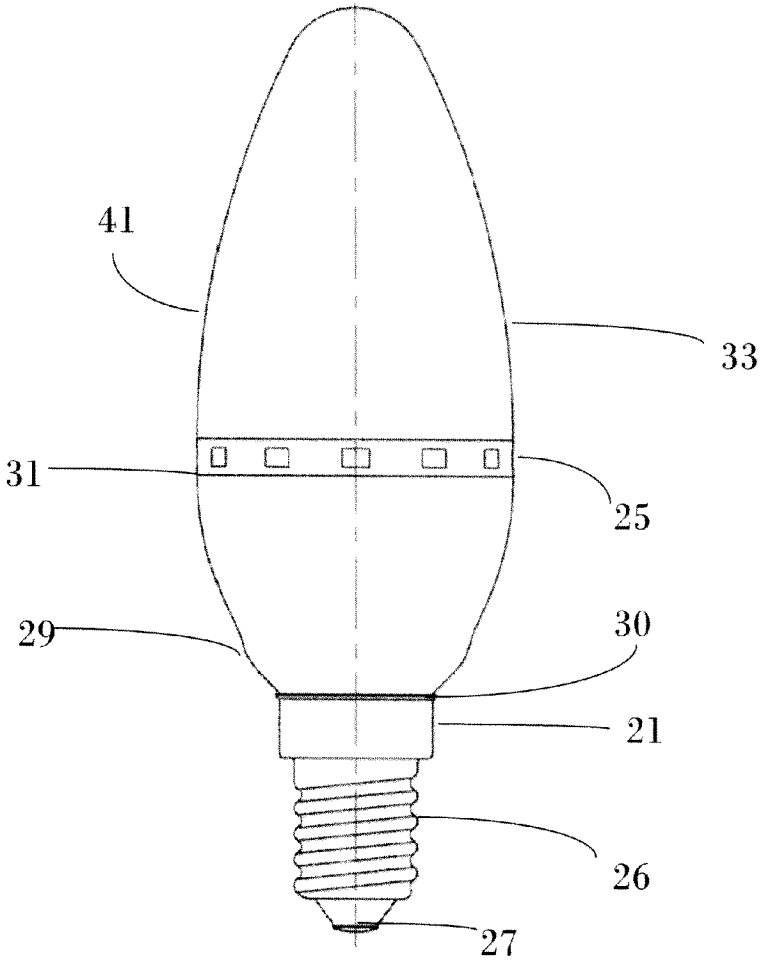
FIG. 2 illustrates a side view of an LED-based light bulb according to one aspect of the present disclosure.

With reference to FIG. 2, an LED light bulb that looks similar to an incandescent candle bulb is illustrated; however, the light bulb uses one or more LEDs as the light source rather than incandescence. In one exemplary embodiment, the LED light bulb includes a base 21 having two electrical contacts, an internal contact 27 and an externally threaded contact, 26. The base 21 is preferably made of an electrically conductive metal according to standard practices known to those skilled in the art. The base is adapted to be compatible with standard incandescent light bulb sockets, preferably of the smaller, candle-type bulb size. The LED light bulbs may include an Edison-type threaded base connector 26 that is formed to be a direct replacement of the Edison base of a conventional incandescent lamp. (More generally, the base connector should be of the same type as the base of the incandescent or halogen lamp to be replaced—for example, if the incandescent or halogen lamp employs a bayonet base then the Edison base connector is suitably replaced by the requisite bayonet base connector). To the casual observer, the LED bulb of FIG. 2 looks like a conventional incandescent light bulb.

In one embodiment, the LED light bulb includes a substantially hollow light transmissive envelope 33 extending upwardly from the base 21 that preferably diffuses light. The envelope 33 may be a glass element, although an envelope of another light-transmissive material such as plastic or other material is also contemplated. The surface of the envelope 33 may diffuse light inherently, or can be made diffusive in various ways, such as: frosting or other texturing to promote light diffusion; coating with a light-diffusive coating such as enamel paint, or a Soft-White or Starcoat™ diffusive coating (available from General Electric Company, New York, USA) of a type used as a light-diffusive coating on the glass envelopes of some incandescent or fluorescent light bulbs; embedding light-scattering particles in the glass, plastic, or other material of the envelope 33; various combinations thereof; or so forth.

According to a preferred embodiment, the light transmissive envelope 33 is dissected into two halves, a first half 29 and a second half 41. The first half 29 includes two ends 30, 31. A first end 30 attaches to the base 21 and the second end 31 extends upwardly. A metal space separator 25 may be mechanically fixed to the second end 31, such that the separator 25 creates a seal, effectively securing the second end 31 in place. Although metal space separator 25 is generally described herein as a disc, the separator may take on any shape depending on the desired application.

Figure 3:
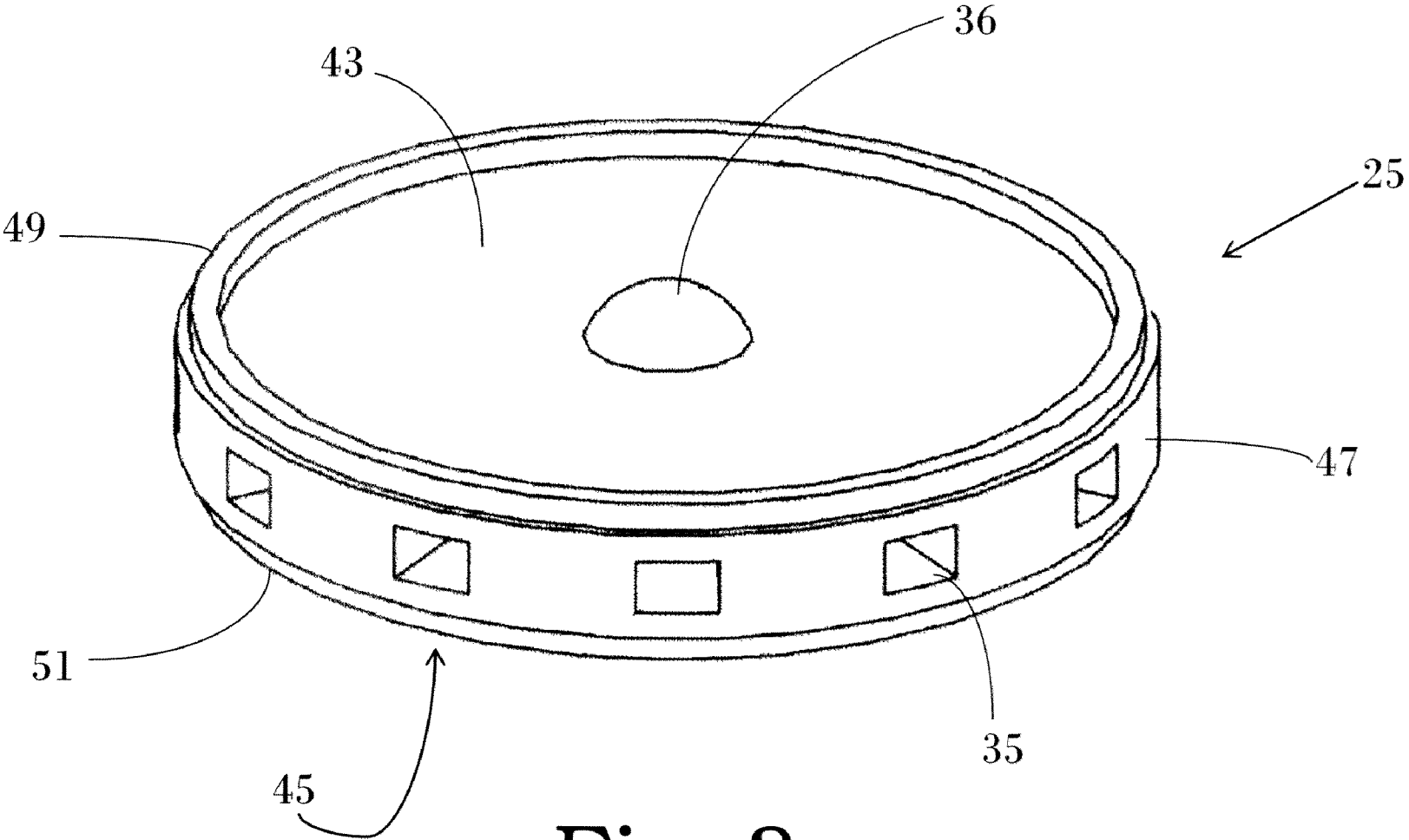
FIG. 3 illustrates an elevated side view of the LED light bulb separator containing an LED-light source according to one aspect of the present disclosure.
Figure 4:
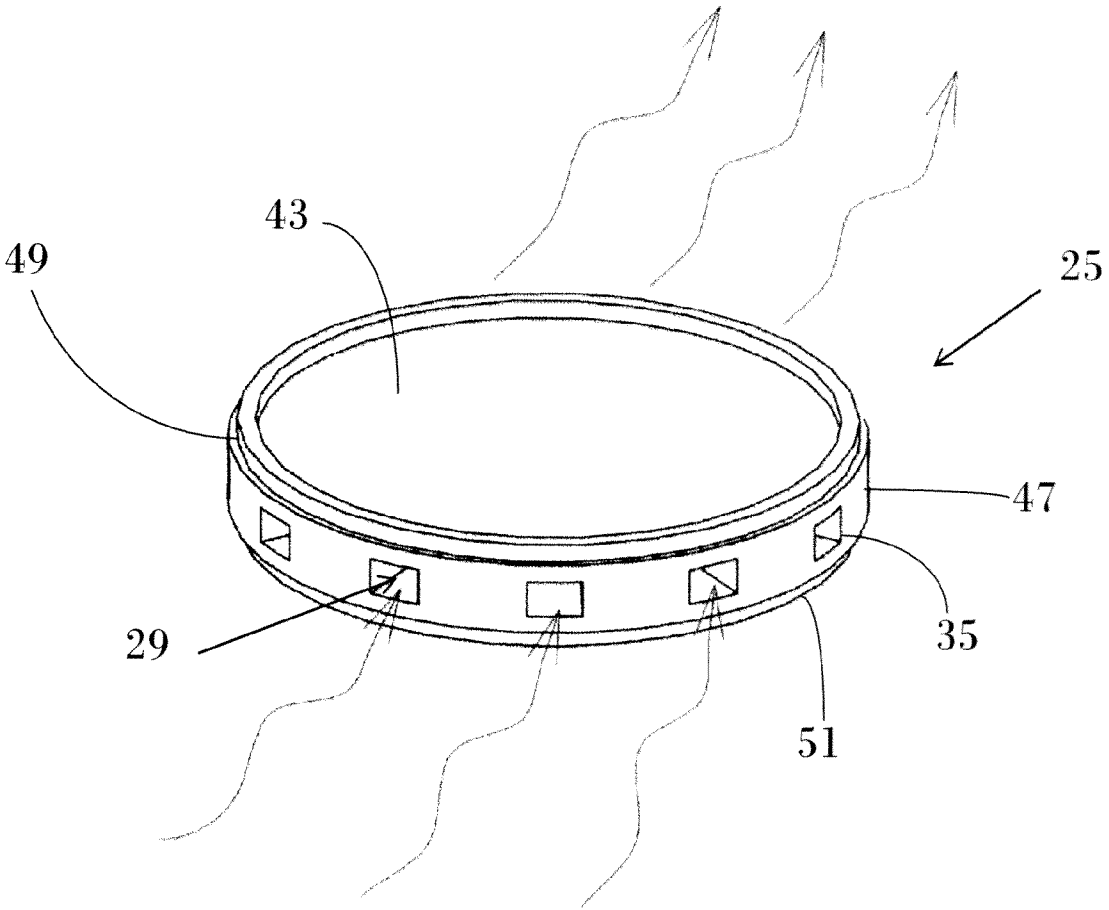
FIG. 4 illustrates an elevated side view of the channels located in the LED light bulb separator according to one aspect of the present disclosure.

FIG. 3 illustrates one embodiment wherein, separator 25 is of a generally planar disc design, such that there is a top side 43, a bottom side 45, and a side wall 47 that is sufficiently thick to accommodate one or more holes 35 that facilitate air circulation throughout the volume of the separator 25. The hole(s) 35 are preferably oriented around the side wall 47 such that two holes are directly across from each other. As seen in FIG. 4, channel 29 extends from opposite holes, traversing the interior of the separator 25. Therefore, the ambient air can move through the separator 25 from one side to another, allowing constant flow and heat transfer throughout the separator.

An LED light source 37, 36 is included in the metal space separator, preferably being fitted on the top side of the separator 25, although the LED may alternatively or additionally be mounted on the bottom side of the separator. Depending on desired intensity, the LED light source may include one or more LEDS (not shown) fitted into the top side 43 of the separator 25 and, therefore, the LED(s) face into the interior of the second envelope half 41 and emit light into the interior of the envelope 33. The separator 25 is made of heat conductive material and may act as a heat sink, absorbing and dissipating heat from the one or more LEDs to the ambient air. The heat sinking separator 25 ensures that the temperature of the LED lamp does not increase to a point that the lamp becomes inefficient. Additionally, since the separator 25 acts as a heat sink for the light bulb, the LED light bulb does not rely upon the lighting socket for heat sinking. As such, the LED bulb of FIG. 2 can be substituted for a conventional integral incandescent or halogen lamp without concern about thermally overloading the socket or associated hardware, and without modifying the electrical configuration of the socket.

Figure 5:
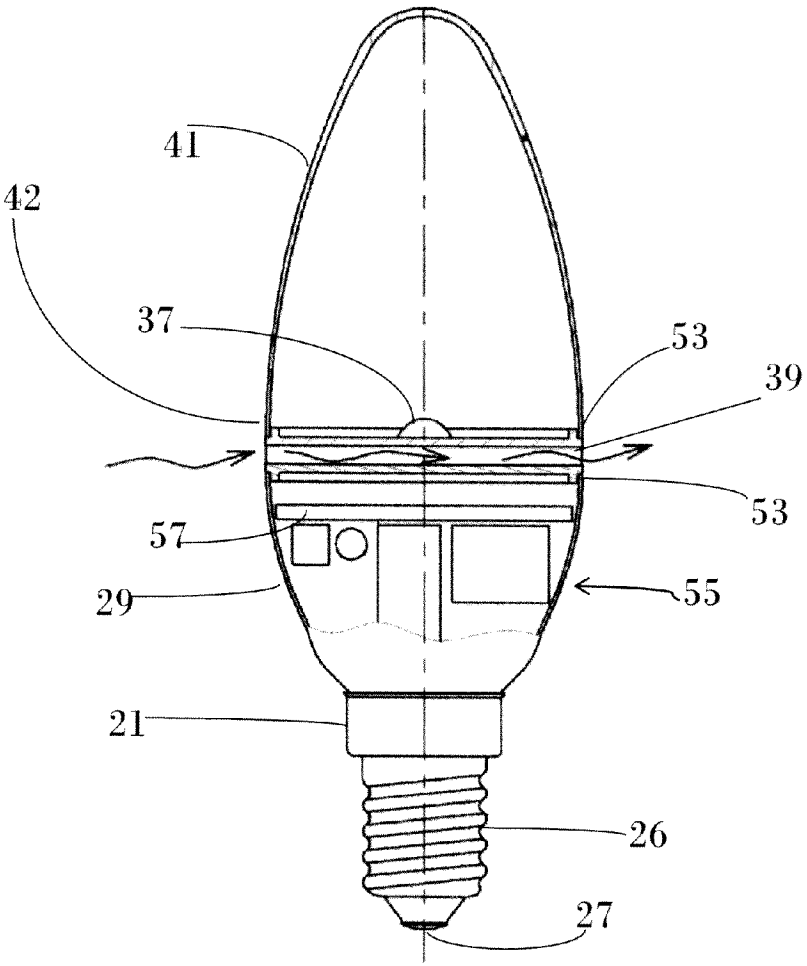
FIG. 5 illustrates a cross-sectional view of an LED-based light bulb according to one aspect of the present disclosure.

In another embodiment, illustrated in FIG. 5, separator 25 comprises two, removable pieces. A first piece (upper piece) includes the LED-based light source 37 and the second piece (lower piece) includes electronics 55. The electronics 55 may include an electronic driver that is interposed between the LED light source 37 and the Edison base connector 21. The electronic driver is sufficient, by itself, to convert the A.C. power received at the Edison base electrical connector (for example, 120 volt A.C. of the type conventionally available at Edison-type lamp sockets in U.S. residential and office locales, or 230 volt A.C. of the type conventionally available at Edison-type lamp sockets in European residential and office locales, or 12 volt or 24 volt or other voltage D.C.) to a form suitable for driving the LED-based light source 37. In embodiments in which the LED light source is configured to be operated directly from the 120 volt or 230 volt A.C. (for example, if the LED-based light source includes a series string of LED devices numbered to operate directly from the A.C., optionally with Zener diodes to accommodate the A.C. polarity switching), the electronic drivers are suitably omitted. Therefore, it is possible to change one piece and not have to replace the entire bulb. Since the LEDs work with voltages below 12 V, there is no risk of electrical shock if the user touches the electronic connectors with bare hands.

Figure 6:
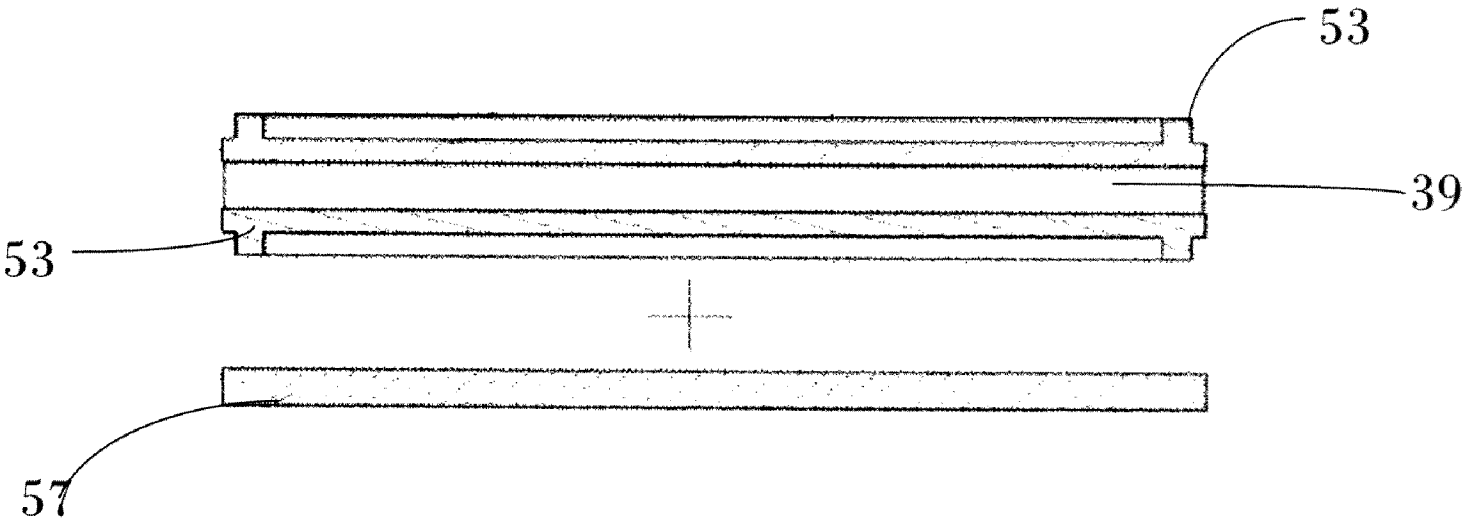
FIG. 6 illustrates a schematic side view of the LED light bulb separator according to one aspect of the present disclosure.

FIG. 6 provides a detailed illustration of one embodiment of the separator 25 having a channel 39, 35 extending between the two pieces of the separator. The pieces preferably function as heat sinks 53 that work to transfer heat into the open space of the channel 39 and into the ambient air. Optionally, the separator can include a layer of insulation 57 between the electronics 55 and the light source 37.

As further shown in FIG. 5, the second half of the envelope 41 extends upwardly from the top side of the separator 25 creating a hollow dome-like enclosure over the top side 43 and also over the one or more LEDs 37. The second half 41 includes an open end 42 that is mated to the top side 43 of separator 25. The second half 41 comprises an optical light transmissive material and is preferably shaped at least similarly to a typical candle bulb. The envelope 33 optionally may also include a phosphor, for example coated on the surface, to convert the light from the LEDs to another color, for example to convert blue or ultraviolet (UV) light from the LEDs to white light. In some such embodiments, it is contemplated for the phosphor to be the sole component of the envelope 33. In such embodiments, the phosphor should be a diffusing phosphor. In other contemplated embodiments, the diffuser includes a phosphor plus an additional diffusive element such as frosting, enamel paint, a coating, or so forth.

In one embodiment, detailed in FIG. 3, separator 25 includes raised lip portions 49, 51 on each of the top side 43 and the bottom side 45. First and second halves 29, 41, preferably also have a corresponding ridges on each respective end 31, 42, such that the halves can be press-fit and fixedly attached to the base 21, creating an air-tight seal. Alternatively, the halves can be secured to the separator by other known means, including glue, epoxy resin, silicone or the like.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. An LED light bulb comprising;

a base providing an electrical connector;

a substantially hollow light transmissive envelope;

a disc-shaped metal space separator having a top side, bottom side and side wall, the side wall including a plurality of holes connected by at least one channel that extends through the interior of said separator, such that air can pass through the separator; and at least one LED mounted on said separator in electrical connection with said base connector, wherein the at least one LED is mounted on the top side and at least one LED is mounted on the bottom side of said separator;

said light bulb having a longitudinal axis intersecting said base, envelope and separator, said at least one channel being at least substantially transverse to said longitudinal axis; and wherein said separator dissects the envelope and said side wall forms a portion of the outer surface of said light bulb.

2. The LED light bulb of claim 1, wherein said plurality of holes are oriented such that pairs of holes are directly across the length of the separator from one another.

3. The LED light bulb of claim 1, wherein an upper envelope half is adapted to attach to the top side of said separator, forming a dome-like enclosure over the top side of said separator.

4. The LED light bulb of claim 3, wherein a lower envelope half includes two ends, a first end adapted to attach to said base, and a second end adapted to attach to the bottom side of said separator.

5. The light bulb of claim 1, wherein said separator is comprised of a heat conductive material.

6. The light bulb of claim 1, wherein said base connector is an Edison-type connector.

7. An LED lamp comprising:

an LED-based light source;

an Edison-type base connector configured to electrically power the LED-based light source using electrical power received from said base connector;

a first light transmissive envelope half having a first end attached to said base, and a second end opposite thereto;

a disc-shaped metal space separator having a top side, a bottom side, and a sidewall, wherein a portion of the side wall forms an outer surface of said light bulb, and wherein said second end of said first light transmissive envelope half is mated to the bottom side of said separator, the lamp having a longitudinal axis intersecting said first and second envelopes and said separator; and said separator including a plurality of interior channels extending between openings in said side wall; said channels being at least substantially transverse to said longitudinal axis; and a second light transmissive envelope half mated to the top side of said separator; and at least one LED mounted on said separator.

8. The LED light bulb of claim 7, wherein said top side and said bottom side of said separator include raised lip portions along the outer edge of said separator.

9. The LED light bulb of claim 7, wherein said first and second envelope halves include ridges adapted to press-fit with said raised lip portions, creating a seal.

10. The LED light bulb of claim 7, wherein the sidewall of said separator includes a plurality of holes, oriented such that at least two holes are directly across from one another.

11. The LED light bulb of claim 10, wherein said plurality of channels traverse the separator and connect opposite holes.

12. The LED light bulb of claim 7, wherein said separator is comprised of heat conductive material and is adapted to function as a heat sink.

13. The LED light bulb of claim 7, wherein said separator comprises two removably attached pieces, an upper piece and a lower piece.

14. The LED light bulb of claim 7, wherein said upper separator piece includes the light source and said lower separator piece includes the light bulb electronics.

15. The LED light bulb of claim 7, wherein said second envelope half includes a phosphor adapted to convert the light from the light source to another color.

16. A candle-shaped LED light bulb for use as a replacement light bulb for an incandescent light bulb, comprising:

an LED light source;

a base;

a generally planar disc shaped separator having a top side, a bottom side, and a sidewall, said top and bottom sides each including a raised lip portion along the outer edge of said separator;

an envelope comprising a first at least partially light transmissive envelope half and a second at least partially light transmissive envelope half, said first envelope half having a first end being attached to said base and a second end mated to said bottom side, and said second half having an open end attached to said top side; wherein at least one of said second end and said open end includes ridges adapted to press-fit with said raised lip portions, creating a seal; and a plurality of holes disposed in said sidewall, oriented such that pairs of holes are directly across the length of the separator from one another and connected by at least one channel that extends through the interior of said separator, such that air can pass through the separator to an exterior of said envelope.

* * * * *